US009735505B2

(12) United States Patent
Wendt et al.

(10) Patent No.: US 9,735,505 B2
(45) Date of Patent: Aug. 15, 2017

(54) HOUSING DEVICE FOR AN ELECTRICAL CONNECTION TERMINAL AND ELECTRICAL CONNECTION TERMINAL

(71) Applicant: PHOENIX CONTACT GMBH & CO. KG, Blomberg (DE)

(72) Inventors: Andreas Wendt, Berlin (DE); Ralf Beckmann, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/023,425

(22) PCT Filed: Sep. 23, 2014

(86) PCT No.: PCT/EP2014/070174
§ 371 (c)(1),
(2) Date: Mar. 21, 2016

(87) PCT Pub. No.: WO2015/040229
PCT Pub. Date: Mar. 26, 2015

(65) Prior Publication Data

US 2016/0211613 A1 Jul. 21, 2016

(30) Foreign Application Priority Data

Sep. 23, 2013 (DE) ..... 10 2013 110 478

(51) Int. Cl.
*H01R 13/639* (2006.01)
*H01R 13/74* (2006.01)

(52) U.S. Cl.
CPC ..... *H01R 13/639* (2013.01); *H01R 13/741* (2013.01); *H01R 13/745* (2013.01)

(58) Field of Classification Search
CPC ... H01R 13/639; H01R 13/741; H01R 13/745
(Continued)

(56) References Cited

U.S. PATENT DOCUMENTS 2,869,094 A * 1/1959 Francis ..... H01R 13/745 439/550
3,573,716 A * 4/1971 Garver ..... H01R 13/743 439/353

(Continued)

FOREIGN PATENT DOCUMENTS

JP 402603 Y 1/1965

OTHER PUBLICATIONS

International Search Report of PCT/EP2014/070174, Dec. 12, 2014, pp. 1-2.

*Primary Examiner* — Alexander Gilman
(74) *Attorney, Agent, or Firm* — Leydig, Voit & Mayer, Ltd.

(57) ABSTRACT

A housing device for an electrical connection terminal has a terminal housing and latching systems with two latching units interacting with one another, wherein one latching unit is a latching arm connected to the terminal housing and extending out away from the terminal housing, and the second latching unit is a latching connector for interacting with the latching arm for latching. The latching connector has a latching body with a wedge-like shape in a latching direction, along a movement of the two latching units during latching. A latching toothed portion is provided on at least one transverse surface of a first of the two latching units and a meshing unit is provided on transverse surfaces of a second of the two latching units. The latching toothed portion and the meshing unit mesh with one another so as to latch in order to latch the latching units interacting with one another.

15 Claims, 2 Drawing Sheets

(58) Field of Classification Search
USPC ..... 439/345, 352, 358, 329
See application file for complete search history.

(56) References Cited

U.S. PATENT DOCUMENTS

| | | | | | |
|---|---|---|---|---|---|
| 4,462,654 | A * | 7/1984 | Aiello | H01R 13/6273 | 285/320 |
| 4,726,783 | A * | 2/1988 | Nakazawa | H01R 13/6275 | 439/350 |
| 4,730,856 | A * | 3/1988 | Washizu | F16L 37/0985 | 285/319 |
| 4,804,208 | A * | 2/1989 | Dye | F16L 37/56 | 285/124.4 |
| 5,199,896 | A * | 4/1993 | Mosquera | H01R 12/714 | 29/842 |
| 5,207,593 | A * | 5/1993 | Bogiel | H01R 13/6275 | 439/345 |
| 5,219,188 | A * | 6/1993 | Abe | F16L 37/0982 | 285/319 |
| D373,192 | S * | 8/1996 | Murphy | D13/147 | |
| 5,876,246 | A * | 3/1999 | Martin | H01R 13/743 | 439/557 |
| 6,171,131 | B1 * | 1/2001 | Lee | H01R 13/6273 | 439/358 |
| 6,343,814 | B1 * | 2/2002 | Bucher | F16L 37/0982 | 285/319 |
| 6,343,948 | B1 * | 2/2002 | Nutzel | H01R 13/6273 | 439/358 |
| D467,876 | S * | 12/2002 | Lee | D13/147 | |
| 6,502,958 | B1 | 1/2003 | Chen | | |
| D488,778 | S * | 4/2004 | Ushiro | D13/133 | |

* cited by examiner

HOUSING DEVICE FOR AN ELECTRICAL CONNECTION TERMINAL AND ELECTRICAL CONNECTION TERMINAL

CROSS-REFERENCE TO RELATED APPLICATIONS

This application is a U.S. national stage application under 35 U.S.C. 0371 of International Application No. PCT/EP2014/070174, filed on Sep. 23, 2014, and claims benefit to German Patent Application No. DE 10 2013 110 478.9, filed on Sep. 23, 2013. The International Application was published in German on Mar. 26, 2015, as WO 2015/040229 A1 under PCT Article 21(2).

FIELD

The present invention relates to a housing device comprising a terminal housing for an electrical connection terminal and a connection terminal of this kind, it being possible to attach the terminal housing to a component by means of a locking system.

BACKGROUND

A wide variety of housing devices for electrical connection terminals which can be applied to the housing of an electrical installation have become known in the prior art.

SUMMARY

An aspect of the invention provides a housing device, comprising: a terminal housing for an electrical connection terminal; and a locking system including first and second interacting latching units, the first interacting latching unit including a latching arm and the second interacting latching unit including a latching connector, wherein the latching arm is connected to the terminal housing and extends away from the terminal housing, wherein the latching connector is configured to interact with the latching arm for locking, wherein the latching connector includes a latching body having a cuneiform shape in a latching direction of a movement of the two latching units during locking, wherein the latching connector includes a latching toothing, provided on at least one oblique surface of the latching connector, and wherein the latching arm includes an engagement unit, provided on at least one oblique surface of the latching arm, such that the latching toothing and the engagement unit interlock in order to lock the interacting latching units.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
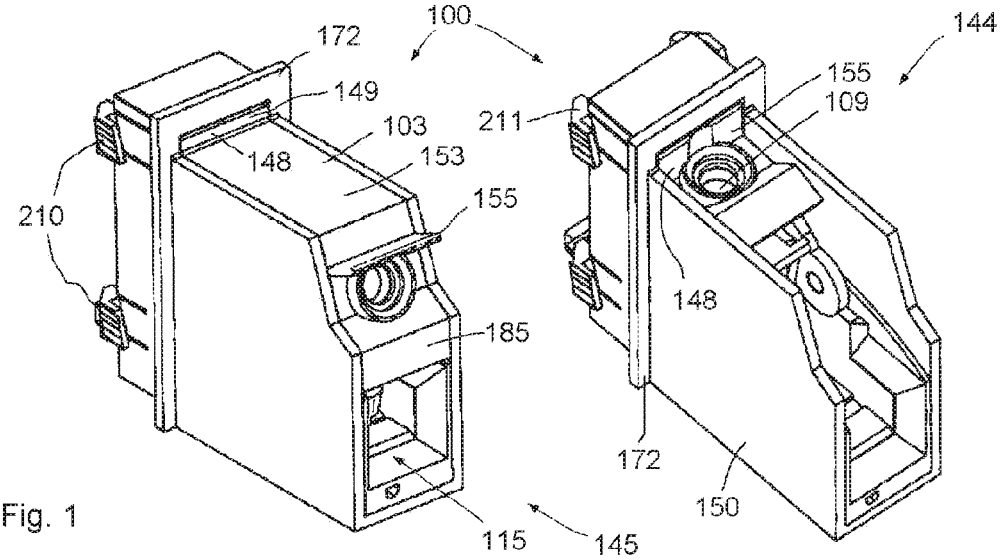
FIG. 1 is a perspective view of a connection terminal in the contact position and in the open position.

An aspect of the present invention provides a further housing device by means of which a housing device can be connected to another component or attached to an electrical installation in a simple and flexible manner.

A housing device according to the invention comprises a terminal housing for an electrical connection terminal and at least one locking system. The locking system comprises two interacting latching units. In this case one latching unit is designed as a latching arm which is connected to the terminal housing and extends away from the terminal housing. The other latching unit is designed as a latching connector and is intended to interact with the latching arm. In this case the latching connector comprises a latching body which has a cuneiform shape in a latching direction of a locking movement of the two latching units. A latching toothing is provided on at least one oblique surface of a first of the two latching units. An engagement unit is provided on at least one oblique surface of a second of the two latching units such that the latching toothing and the engagement unit interlock for the purpose of locking, in order to lock the interacting latching units.

A housing device according to the invention has many advantages since it allows for simple construction and allows the housing device to be fixed to another component such as an electrical installation or the like in a simple manner.

Owing to the latching toothing and the engagement unit being provided on oblique surfaces that are oriented transversely to the latching direction, simple and permanently secure locking of the housing device is made possible.

In this case, the latching direction is preferably a first direction. A second direction, which is perpendicular to the first direction, preferably extends through the oblique surfaces, which can be formed for example on transverse sides. The oblique surfaces are preferably provided in parallel with or approximately in parallel with the first direction. However, it is also possible for the oblique surfaces to be oriented at an angle thereto of between in particular 0° and 30°.

Advantageously, the engagement unit comprises at least one latching tooth and in particular a plurality of latching teeth, which are preferably arranged in the manner of a latching toothing or form a latching toothing of this kind.

It is also preferred for a latching toothing to be provided on the latching connector. The latching toothing on the latching connector is preferably longer or has more latching teeth than the latching toothing on the latching arms. As a result, the latching body of the latching connector can be pushed in the latching direction until a tight fit of the terminal housing is achieved. In the process, the length of the latching body of the latching connector and the slope of the cuneiform shape of the latching body are dimensioned in such a way that typical clamping distances can be maintained.

It is preferable for the latching arm to be approximately U-shaped at its free end, the U-shape comprising a returning leg and a groove between the leg and the body of the latching arm.

The engagement unit is advantageously arranged on an outer surface of the leg. This means that the engagement unit designed as a latching toothing is preferably arranged on the outer surface of the leg. It is preferable for at least two latching arms to be arranged symmetrically on the terminal housing. In particular, the at least two latching arms are arranged mirror-symmetrically to one another. It is also possible for the latching arms to be formed or arranged point-symmetrically. A mirror-symmetrical arrangement of the engagement units or the latching toothings of the latching arms leads to the latching connectors being fitted on the outer sides.

It is particularly preferable for at least one latching arm to be provided on opposing sides of the terminal housing in each case, at least one latching tooth and the latching toothing of the latching arm being provided in each case on the outer surfaces which face away from one another.

It is preferable in all of the embodiments for at least one latching tooth of the latching arm to be resiliently prestressed outwards. As a result, the latching tooth of the latching arm automatically engages in the latching toothing of the latching connector.

In preferred embodiments, a guide groove is provided on at least one latching connector. The guide groove in particular receives the returning leg of a latching arm. The latching toothing is preferably provided on the guide groove such that the guide groove is formed as a latch slot. By pushing the guide groove onto the leg of the latching arm returning from the free end, the latching arm locks with the latching connector. If the body of the latching connector has a cuneiform shape in the latching direction, the latching connector is axially displaced onto the terminal housing with increasing movement during locking.

At least one bearing portion is preferably provided on the terminal housing, which bearing portion is intended to bear against a wall of an electrical installation on which the housing device is intended to be received. For this purpose of mounting, the terminal housing is inserted through a recess or an opening in the wall of the electrical installation until the bearing portion rests against the wall of the electrical installation. In the process, the latching arms enter pass through the opening in the wall. In order to fix the housing device to the wall, the latching connectors are hereinafter fitted on the latching arms, so the spacing between the latching connectors and the bearing portion of the terminal housing decreases to the extent that the terminal housing is firmly held on the wall of the electrical connection device. Different spacings and wall thicknesses can be compensated for by the wedge shape of the latching connectors.

Preferably, a plurality of latching connectors are interconnected. In the process, the individual latching connectors can be interconnected by means of one or more resilient connectors. A resilient connector of this kind can be a flexible element such as a cable or a filament or the like. An advantage of interconnecting a plurality of latching connectors is the captive holding. A rigid connector can optionally also be provided in order to simultaneously attach a plurality of latching connectors to a terminal housing in one work step.

In particularly preferred embodiments, at least one counter bearing element is provided on the terminal housing for locally supporting at least one latching arm. A counter bearing element of this kind can be designed for example as a wall element which is separated from the latching arm in particular by a gap.

It is possible and preferred for the wall element to form the counter bearing element for two latching arms that are spaced apart from one another. One of the latching arms is then supported on the wall element on one side and the other latching arm is supported against the wall element from the other side. In embodiments of this type, the counter bearing element defines a minimum spacing of the latching arms in the latching state.

The latching arms and the counter bearing element preferably form a U-shaped or H-shaped portion, such that the wall element absorbs and dissipates the force in its longitudinal direction. The wall element is arranged in particular between the latching connectors such that the minimum spacing thereof is defined and predetermined by the wall element. In the locked state, the minimum spacing of the latching arms is also predetermined as a result. Without latching connectors, however, the latching arms can also pivot inwards.

It is preferable for the counter bearing elements and the latching arms to be part of a peripheral housing contour or to form at least one part of a housing contour of this kind.

In all of the embodiments it is preferable for the latching arms to be able to elastically deform towards one another if no latching unit is locked.

In all of the embodiments it is preferable for an electrical connection terminal to be held on the housing device.

In this respect the invention is also directed to an electrical connection terminal comprising a housing device in which a terminal housing and a locking system are provided. The locking system comprises two interacting latching units.

In this case one latching unit is designed as a latching arm which is connected to the terminal housing and extends away from the terminal housing. The other latching unit is designed as a latching connector and is intended to interact with the latching arm for the purpose of locking. In this case, the latching connector comprises a latching body which has a cuneiform shape in a latching direction of a movement of the two latching units during locking. A latching toothing is provided on at least one oblique surface of a first of the two latching units and an engagement unit is provided on at least one oblique surface of a second of the two latching units, such that the latching toothing and the engagement unit interlock for the purpose of locking in order to lock the latching units which interact with one another.

The electrical connection terminal according to the invention also has many advantages since the terminal housing of the electrical connection terminal can be flexibly and simply connected to a wall of an electrical installation for example.

In preferred developments, the housing device has at least one feature of a housing device as described above.

The design and the functioning of a connection terminal 100, formed here as a lead-through terminal, and an electrical installation 500 equipped with at least one connection terminal 100 of this kind are described in the following with reference to the accompanying figures.

FIG. 1 shows side by side two perspective views of a connection terminal 100, specifically in the clamped state or in the contact position 145 on the left and in the open state or in the open position 144 on the right.

Figure 4:
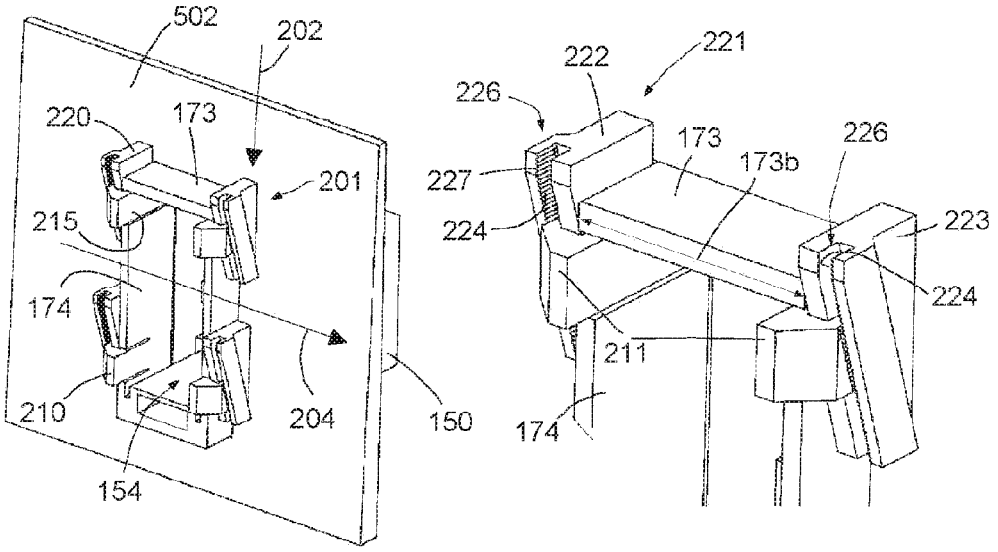
FIG. 4 is a schematic perspective view of a wall of an electrical installation comprising a terminal housing held thereon and an enlarged detail.

The connection terminal 100 comprises a terminal housing 150 and is intended to be locked to a wall 502 of an electrical installation 500 by means of a locking system 201. In the process, the wall 502 is clamped between the bearing portion 172 and the latching unit 220, as shown in FIG. 4.

FIG. 1 shows the conductor receptacle 115 which is largely closed in the contact position 145 shown on the left, whilst a particularly large opening angle of 75° or more results between the current bar and the clamping lever in the open position 144 shown on the right. It is thereby possible to pivot a conductor into the conductor receptacle 115, which can make the connection considerably easier, in particular for conductors having a cross section of several square millimetres.

The terminal housing 150 consists in particular of an electrically non-conductive material and preferably of a plastics material. The bearing portion 172 can be provided as a peripheral ridge, by means of which the connection terminal 100 is supported peripherally on the wall 502. It is also possible for the bearing portion 172 to consist of a plurality of segments or to comprise individual support elements.

The tool opening 109 in the connection terminal 100 can be seen both in the contact position 145 and in the open position 144, which tool opening is provided in the actuation device 103. The actuation device 103 comprises a cover housing in the form of a cover 153. The cover 153 consists here of an insulating material and protects the inside of the actuation device 103 and also the inside of the connection terminal 100 against mechanical contacts. The air gaps and creepage paths are also increased quite considerably by means of the cover 153.

The terminal housing 150 can comprise an outer housing 170 and an inner housing 160, on which the mount 108 is held. The mount 108 preferably consists of metal and in particular of a punched and bent part. The outer housing and the inner housing preferably consist of a plastics material. During mounting, the mount 108 is held on the inner housing 160 and the required metal parts and clamping parts are mounted. Together with the mount 108, the inner housing forms a pre-assembled unit, which only needs to be inserted into the outer housing 170 or inserted or locked in place in an outer housing that is already provided on an electrical installation 500 and is for example integral with the wall.

The connection terminal 100 comprises the pivotable actuation device 103. By means of pivoting the actuation device 103, the connection terminal can be opened or closed again. When pivoting the actuation device 103, a gap 148 can be formed between the peripheral wall of the bearing portion 172 and the cover 153 of the actuation device 103, specifically at the point where the closure ridge 149 is provided in the contact position 145. If the actuation device 103 is pivoted to the rear from the closed position shown on the left in FIG. 1, the connecting ridge 149 is pivoted through the wall feedthrough 154 and thus through the wall 502 into the electrical installation 500. Simultaneously, a gap 148 between the wall 172 and the cover 153 can be formed at the point where the closure ridge 149 was previously arranged. When pivoting further into the open position 144, the gap 148 is closed again by the deflector 155, in such a way that there is no gap 148 in the open position. The gap 148 is spaced apart from the conductor receptacle 115 and is independent of the conductor receptacle 155.

Figure 2:
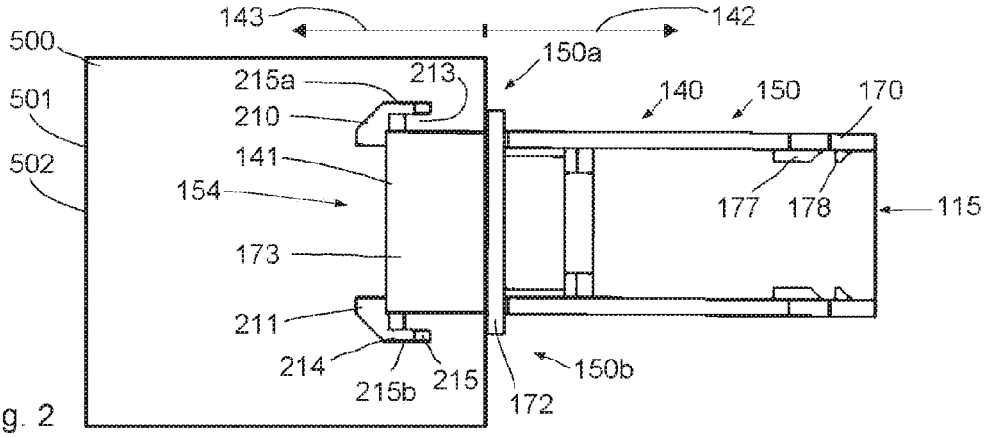
FIG. 2 is a schematic plan view of a wall of an electrical installation comprising a terminal housing held thereon.

FIG. 2 is a highly schematic plan view of an electrical installation 500 comprising a wall 502, on which a connection terminal 100 is held, of which for the sake of clarity only the outer housing 170 is shown in FIG. 2. In the interior of the outer housing 170, lugs 177 and 178 are provided, on which the inner housing 160 is locked during mounting.

In FIG. 2, the shape of the latching units 210 of the locking system 201 can be seen. The latching units 210 are designed as latching arms 211. The legs 215 of the latching arms 211 extending outwards away from the terminal housing 150 are covered here by the support wall 173, which also functions as a counter bearing element 173*a*. The width 173*b* (cf. FIG. 4) of the support wall 173 here corresponds exactly to the outer spacing of the two latching arms 211 that can be seen in FIG. 2.

It is thereby ensured, as will be described with reference to FIG. 4, that the latching arms 211 can be temporarily resiliently pivoted inwards during mounting on the wall 502, but later are retained on the outside by the latching units 220 interacting with the latching arms 211, so that the cross section of the wall feedthrough 154 remains free on the inside.

Figure 3:
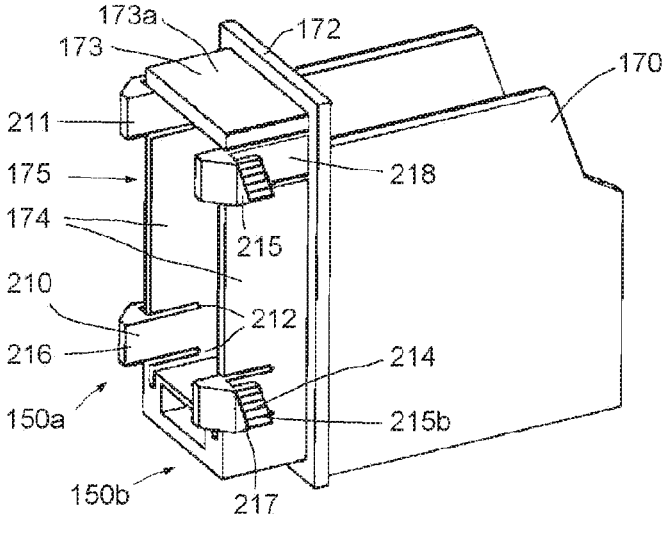
FIG. 3 is a perspective view of a terminal housing.

FIG. 3 shows a perspective view of the terminal housing 150 or the outer housing 170 thereof, which comprises the first housing portion 140 on a first side 142 of the bearing portion 172 and thus outside of the electrical installation 500. On the second side 143, the second housing portion 141 is arranged inside the housing 501. The second housing portion 141 here functions as fastening portion on which the counter bearing elements 173*a* together with the latching arms 211 and the walls 174 provide a peripheral wall 175. The interior of the second housing portion 141 is thereby mechanically protected against influences and contacts when, for example, part of the actuation device 103 enters the second housing portion 141 during the opening movement.

The latching arms 211 are approximately U-shaped at the free ends 216. Between the returning leg 215 and the latching arm 211, a groove 213 is provided which a part of the latching unit 220 enters (cf. FIG. 4).

On the outer oblique surface 214, an engagement unit 217 is provided, which is here designed as a latching toothing or a plurality of latching teeth. The latching toothings 217 on the opposing latching arms 211 are each arranged on the outer surfaces 215*a*, 215*b* which face away from one another and are each positioned transversely to the transverse direction 204 (cf. FIG. 4). The outer surfaces 215*a*, 215*b* can be arranged perpendicularly to the transverse direction 204, but are arranged in particular at a slight angle thereto of between 0° and 30°.

Owing to the grooves 212 between the side wall and the latching arms 211, the latching arms 211 can resiliently deflect during mounting.

FIG. 4 shows a connection terminal mounted on a wall 502 of an electrical installation 500, in which connection terminal a part of the second housing portion 141 of the terminal housing 150 can be seen schematically behind the wall 502. However, in principle, the terminal housing 150 is also suitable for use in other electrical connection terminals.

Figure 5:
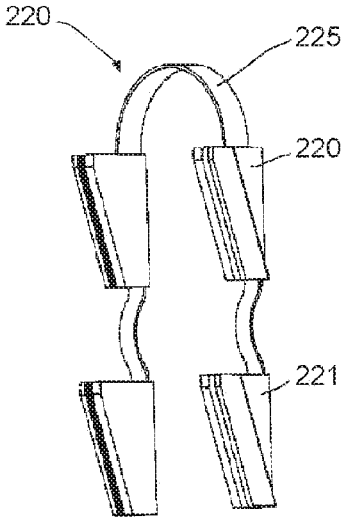
FIG. 5 is another latching unit for the terminal housing according to FIG. 4.

A locking system 201 is provided for the purpose of fastening, and here comprises four latching units 210 and four latching units 220. The latching units 210 are designed as latching arms 211 that are held resiliently on the terminal housing 150 and extend outwards away from the terminal housing 150 up to their free end 216, where the latching arms 211 are U-shaped such that the latch groove 213 formed therebetween is suitable for receiving the latching units 220. The latching units 220 designed as latching connectors 221 can be individual separate parts as shown in FIG. 4, or they can be interconnected by a flexible connector 225 or a bracket, for example, as shown in an enlarged view in FIG. 5.

Each latching connector 221 comprises a latching body 222 which has an approximately cuneiform structure 223, in order to be able to bring about clamping on walls 502 of different thicknesses or cuneiform walls.

For the purpose of mounting, the second housing portion 141 of the terminal housing 150 can be inserted through the opening in the wall 502, the resilient latching arms 211 temporarily elastically deforming inwardly when the particular latching arm 211 passes through the wall 502. Subsequently the latching arms 211 snap back outwards. The terminal housing 150 cannot then be readily removed. The latching units 220 are then fitted on in order to fasten the terminal housing 150. In the process, the latching connectors 221, by means of their groove 226, are fitted on the leg 215 of the latching arms 211 so that the locking elements 217 on the oblique surface 224 are brought into a latching connection with the latching toothing 227 on the latching connectors 221. During the movement of the latching connectors 221 in the latching direction 202, the ends of the latching arms 211 are clamped by the cuneiform latching body 222 of the latching connectors 221 and pressed away from the wall 502. Secure retention can thus be ensured, even in the case of different wall thicknesses or cuneiform or stepped walls 502. In this case, the latching toothing 227 extends transversely to the connection direction. The latching toothings 217 and 227 are each provided on oblique surfaces 214 and 224, respectively, which rest against one another in the mounted position.

The four individual latching arms 211 are each individually clamped in such a way that even locally different wall thicknesses of the wall 502 are immaterial to the individual latching arms 211.

As shown in FIG. 4, the support wall 173 forms a counter bearing element 173*a* having a width 173*b*, against which element the adjacent latching arms 211 are supported. It is thus ensured that the wall feedthrough 154 or the space between the support walls 173 remains free. If a resilient latching arm 211 does not resiliently (fully) bend outwards again itself after being inserted into the wall 502, the latching arm 211 is pulled outwards through the latching connectors 221, since the latching connectors 221 are supported on the support wall 173, acting as a counter bearing 173*a*, by their latching bodies 222.

Reliable operation of the connection terminal 100 can thus be achieved, since when the actuation element 103 is transferred from the contact position 145 into the open position 144, the clamping spring 101 and other components of the actuation device are pivoted in part through the wall feedthrough 154. In an embodiment of this kind, it must therefore be ensured that the installation space inside the electrical installation 500 that the second housing portion 141 occupies does not hinder the pivoting movement.

Figure 6:
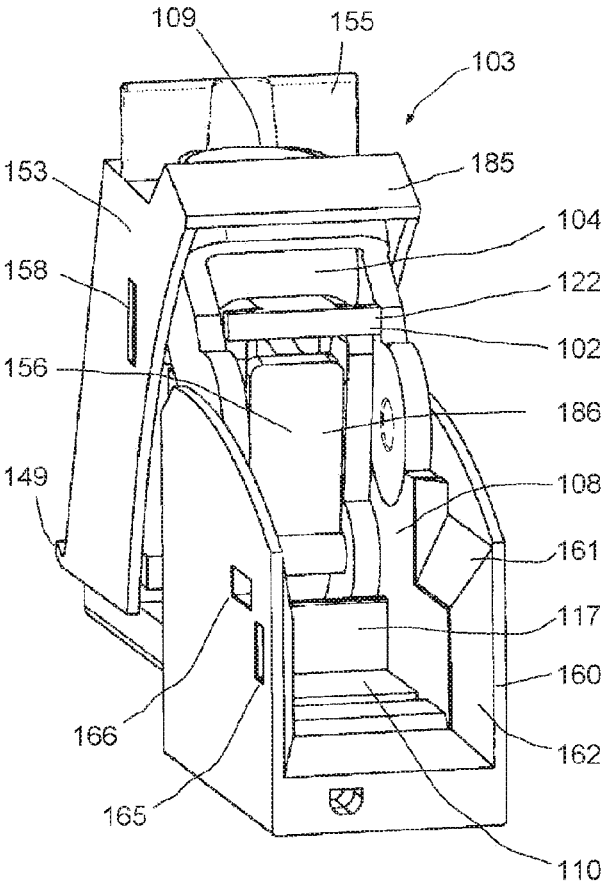
FIG. 6 is a schematic perspective view of an open connection terminal without an outer housing.

FIG. 6 shows a schematic perspective view of an open feedthrough terminal 100 without an outer housing 170 but having a mounted inner housing 160 made of a plastics material, on which the mount 108 made of metal is received. The mount 108 of the connection terminal 100 has a U-shaped cross section and consists here of a punched and bent part. The current bar 110 is held on the mount 108.

The feedthrough terminal 100 is shown in the open position 144, in which the conductor to be connected can be pivoted into the conductor receptacle 115 from above. A conductor can also be optionally inserted from the front.

Chamfers 161 and 162 are provided on the conductor receptacle 115 as an insertion aid in the plastics wall of the inner housing 160. The latch openings 165 and 166 in the side outer walls are provided for holding the lugs 177 and 178 on the inner walls of the outer housing 170, as a result of which the terminal housing is fixed in itself.

The actuation device 103 is covered by a cover 153. The closure ridge 149 is provided on the cover 153, which ridge closes a gap 148 between the bearing wall or the bearing portion 172 and the wall feedthrough 154 in the contact position 145. In the open position 144, the deflector 155 closes the gap 148. In the contact position 145, the wall 185 covers the conductor receptacle 115 towards the top. Moreover, the wall 185 can delimit an insertion funnel for a tool. An insertion funnel of this kind can be provided if side walls connect the deflector 155 and the wall 185 in such a way that the tool receptacle 109 is surrounded by walls in a funnel-like manner.

An opening 158 can be seen laterally on the cover 153, by means of which an insert device 118 having projections 157 can by locked from the inside.

A penetration guard 117 is provided in the conductor receptacle 115, which guard prevents the conductor to be connected from being inserted too deeply.

Furthermore, the clamping lever 102 having the clamping edge 122, and an auxiliary lever 104, can be seen. The auxiliary lever 104 is rotatably held on the mount 108. Of an insert means inside the actuation device, only the insertion guard 156 can be seen here, which in the open position 144 reliably prevents a conductor being pushed into the region of the clamping spring 101 above the conductor receptacle 115. The insertion guard 156 is part of a multi-functional inner part 186. The inner part 186 comprises the insert device and latching lugs for locking at openings 158 in the cover 153.

The invention provides an advantageous housing device. In this case, at least two latching arms 211 can be symmetrically arranged on the terminal housing 150.

It is preferable for at least one latching arm 211 to be provided at each of the opposite sides 150*a*, 150*b* of the terminal housing 150. At least one latching tooth is provided in each case in particular on the outer surfaces 215*a*, 215*b* facing away from one another. A plurality of latching teeth can also form a latching toothing.

At least one latching tooth or the latching toothing on at least one latching arm 211 is preferably resiliently prestressed outwards.

For the purpose of locking, the latching toothings 217 of the latching arms 211 can be received in a guide groove 226 in the latching connector 210, which groove is formed as a latch slot.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMERALS

Connection terminal 100
Clamping lever 102
Actuation device 103
Auxiliary lever 104
Mount 108
Tool opening 109
Current bar 110
Conductor receptacle 115
Clamping edge 122
Housing portion 140, 141
Side 142, 143
Open position 144
Contact position 145
Gap 148
Closure ridge 149
Housing, terminal housing 150
Side 150*a*, 150*b*
Cover 153
Wall feedthrough 154
Deflector 155
Insertion guard 156
Opening 158
Inner housing 160
Chamfer 161, 162
Latch opening 165, 166
Outer housing 170
Bearing portion 172
Wall 173
Counter bearing element 173*a*
Width 173*b*
Wall 174
Housing contour 175
Lug 177, 178
Wall 185
Multi-functional inner part 186
Locking system 201
Latching direction, first direction 202
Transverse direction 204
Latching unit 210
Latching arm 211
Groove 212, 213
Oblique surface 214
Leg 215
Outer surface 215*a*, 215*b*
Free end 216
Engagement unit, toothing 217
Body 218
Latching unit 220
Latching connector 221
Latching body 222
Cuneiform shape 223
Oblique surface 224
Bracket/connector 225
Groove, guide groove 226
Latching toothing 227
Electrical installation 500
Housing 501
Wall 50

The invention claimed is:

1. A housing device, comprising:

a terminal housing for an electrical connection terminal; and a locking system including interacting first and second latching units, the first latching unit including a latching arm and the second latching unit including a latching connector, wherein the latching arm is connected to the terminal housing and extends away from the terminal housing, wherein the latching connector is configured to interact with the latching arm for locking, wherein the latching connector includes a latching body having a cuneiform shape in a latching direction of a movement of the two latching units during locking, wherein the latching connector includes a latching toothing, provided on at least one oblique surface of the latching connector, wherein the latching arm includes an engagement unit, provided on at least one oblique surface of the latching arm, such that the latching toothing and the engagement unit interlock in order to lock the interacting latching units, wherein the latching arm is U-shaped at its free end, the U-shape including a returning leg and a groove between the returning leg and a body of the latching arm, and wherein the engagement unit is arranged on an outer surface of the returning leg.

2. The device of claim 1, wherein the engagement unit includes a latching tooth.

3. The device of claim 2, wherein the latching tooth of the latching arm is resiliently prestressed outwards.

4. The device of claim 1, wherein the terminal housing includes a first and a second latching arm, symmetrically arranged on the terminal housing.

5. The device of claim 4, wherein latching arms can elastically deform towards one another if no latching unit is locked.

6. The device of claim 1, wherein opposing sides of the terminal housing each include a latching arm, and wherein outer surfaces of the latching arm facing away from one another each include a latching tooth.

7. The device of claim 1, wherein the latching connector includes a guide groove, and wherein the guide groove is formed as a latch slot, on which a latching toothing is provided.

8. The device of claim 1, comprising two or more latching connectors, which are interconnected.

9. The device of claim 8, wherein the latching connectors are interconnected by a connector.

10. The device of claim 1, wherein the terminal housing further includes a counter bearing element, provided on the terminal housing for locally supporting at least one latching arm.

11. The device of claim 10, wherein the counter bearing element is designed as a wall element.

12. The device of claim 10, wherein the counter bearing element and the latching arm are part of a circumferential housing contour.

13. The device of claim 1, wherein the terminal housing further includes a bearing portion configured to bear against a wall of an electrical installation, in order to clampingly hold the terminal housing on the wall between the bearing portion and the latching connectors.

14. An electrical connection terminal, comprising:

a terminal housing; and a locking system including interacting first and second latching units, the first latching unit including a latching arm and the second latching unit including a latching connector, wherein the latching arm is connected to the terminal housing and extends away from the terminal housing, wherein the latching connector is configured to interact with the latching arm for locking, wherein the latching connector includes a latching body having a cuneiform shape in a latching direction of a movement of the two latching units during locking, wherein the latching connector includes a latching toothing, provided on at least one oblique surface of the latching connector, wherein the latching arm includes an engagement unit, provided on at least one oblique surface of the latching arm, such that the latching toothing and the engagement unit interlock in order to lock the interacting latching units, wherein the latching arm is U-shaped at its free end, the U-shape including a returning leg and a groove between the returning leg and body of the latching arm, and wherein the engagement unit is arranged on an outer surface of the returning leg.

15. A housing device, comprising:

a terminal housing for an electrical connection terminal; and a locking system including interacting first and second latching units, the first latching unit including a latching arm and the second latching unit including a latching connector, wherein the latching arm is connected to the terminal housing and extends away from the terminal housing, wherein the latching connector is configured to interact with the latching arm for locking, wherein the latching connector includes a latching body having a cuneiform shape in a latching direction of a movement of the two latching units during locking, wherein the latching connector includes a latching toothing, provided on at least one oblique surface of the latching connector, wherein the latching arm includes an engagement unit, provided on at least one oblique surface of the latching arm, such that the latching toothing and the engagement unit interlock in order to lock the interacting latching units wherein the terminal housing further includes a counter bearing element, provided on the terminal housing for locally supporting the latching arm, and wherein the counter bearing element and the latching arm are part of a circumferential housing contour.

* * * * *